US010697687B2

(12) United States Patent
Lercher et al.

(10) Patent No.: US 10,697,687 B2
(45) Date of Patent: Jun. 30, 2020

(54) REFRIGERATOR AND/OR FREEZER DEVICE

(71) Applicant: LIEBHERR-HAUSGERATE LIENZ GMBH, Lienz (AT)

(72) Inventors: Dominik Lercher, Nikolsdorf (AT); Hannes Stocker, Iselsberg (AT); Markus Kofele, Hopfgarten (AT)

(73) Assignee: LIEBHERR-HAUSGERATE LIENZ GMBH, Lienz (AT)

( * ) Notice: Subject to any disclaimer, the term of this patent is extended or adjusted under 35 U.S.C. 154(b) by 0 days.

(21) Appl. No.: 16/326,380

(22) PCT Filed: Oct. 6, 2017

(86) PCT No.: PCT/EP2017/001186
§ 371 (c)(1),
(2) Date: Feb. 19, 2019

(87) PCT Pub. No.: WO2018/065095
PCT Pub. Date: Apr. 12, 2018

(65) Prior Publication Data

US 2019/0219318 A1 Jul. 18, 2019

(30) Foreign Application Priority Data

Oct. 6, 2016 (DE) ..... 10 2016 012 004
Jan. 4, 2017 (DE) ..... 10 2017 000 038

(51) Int. Cl.
*F25C 5/00* (2018.01)
*F25D 23/12* (2006.01)
*F25C 5/20* (2018.01)

(52) U.S. Cl.
CPC ..... *F25C 5/22* (2018.01); *F25D 23/126* (2013.01); *F25D 2400/18* (2013.01)

(58) Field of Classification Search
CPC ..... F25C 5/22; F25D 23/126; F25D 2400/18
See application file for complete search history.

(56) References Cited

U.S. PATENT DOCUMENTS 4,209,999 A * 7/1980 Falk ..... F25C 5/22 62/344
7,316,121 B2 * 1/2008 Lee ..... F25D 23/025 62/344

(Continued)

FOREIGN PATENT DOCUMENTS

DE 102010062737 A1 6/2012
DE 102015212340 A1 1/2017

(Continued)

OTHER PUBLICATIONS

Search Report issued in corresponding German Patent Application No. 10 2017 000 038.7 dated May 12, 2017 (7 pages).

(Continued)

*Primary Examiner* — Frederick C Nicolas
(74) *Attorney, Agent, or Firm* — Kilyk & Bowersox, P.L.L.C.

(57) ABSTRACT

The present invention relates to a refrigerator unit and/or a freezer unit having at least one dispensing unit for liquid and/or solid substances such as ice or water, wherein at least one actuation element is provided that is configured such that on its actuation, the dispensing unit is moved from a lowered position into a moved out position.

10 Claims, 2 Drawing Sheets

(56) References Cited

U.S. PATENT DOCUMENTS

| | | | | |
|---|---|---|---|---|
| 7,383,689 | B2 * | 6/2008 | Lee | F25D 23/025 62/98 |
| 7,997,452 | B2 * | 8/2011 | Kim | F25D 23/028 222/182 |
| 8,146,783 | B2 * | 4/2012 | Oh | F25C 5/22 222/504 |
| 8,191,378 | B2 * | 6/2012 | Park | F25C 5/22 62/340 |
| 8,196,618 | B2 * | 6/2012 | Kim | F25C 5/22 141/82 |
| 8,201,715 | B2 * | 6/2012 | Park | F25C 5/22 222/504 |
| 2008/0173027 | A1 | 7/2008 | Kim et al. | |
| 2012/0180517 | A1 | 7/2012 | Filho et al. | |
| 2017/0003069 | A1 | 1/2017 | Moertl et al. | |

FOREIGN PATENT DOCUMENTS

| | | | |
|---|---|---|---|
| EP | 1519131 | A1 | 3/2005 |
| EP | 2452139 | B1 | 3/2016 |
| KR | 20070112971 | A | 11/2007 |
| WO | 2009008621 | A2 | 1/2009 |
| WO | 2009104864 | A1 | 8/2009 |

OTHER PUBLICATIONS

International Search Report and Written Opinion issued in corresponding International Patent Application No. PCT/EP2017/001186 (with English translation of International Search Report) dated Jan. 25, 2018 (12 pages).

* cited by examiner

REFRIGERATOR AND/OR FREEZER DEVICE

This application is a National Stage Application of PCT/EP2017/001186, filed Oct. 6, 2017, which claims priority to German Patent Application No. 10 2017 000 038.7, filed Jan. 4, 2017 and German Patent Application No. 10 2016 012 004.5, filed Oct. 6, 2016.

FIELD OF THE INVENTION

The present invention relates to a refrigerator unit and/or a freezer unit having at least one dispensing unit for liquid and/or solid substances such as ice or water.

BACKGROUND OF THE INVENTION

It is known from the prior art to design refrigerator units and freezer units with such dispensing units such as with water dispensers or ice dispensers that are rigidly arranged at the unit. These dispensers can be installed, for example, at the door or in the inner space of the unit. They are typically actuated via a separate movable switch or sensor.

It is disadvantageous with such units known from the prior art that the dispensing unit is not protected and may thus be exposed to damage and contamination.

SUMMARY OF THE INVENTION

It is therefore the underlying object of the present invention to further develop a refrigerator unit and/or a freezer unit of the initially named kind such that an improved protection of the dispensing unit is ensured.

This object is achieved by a refrigerating unit that is a refrigerator unit and/or freezer unit having the features as described herein of claim 1.

Provision is accordingly made that the dispensing unit is lowerable and at least one actuation unit is provided that is configured such that on its actuation the dispensing unit is moved from the lowered position into a moved out position.

In the unactuated state, the dispensing unit is thus outwardly protected from damage and contamination since it is in its lowered position. It is preferably not accessible from the outside in this position.

If the dispensing unit is to be used, it moves from the lowered position into a moved out position in which it serves the dispensing of the product such as ice or water.

The dispensing unit only moves out (which is to be understood as any desired movement out of the lowered position) by the actuation of the actuation element and enables the dispensing of any desired solid, liquid, or other product. The solid or liquid substances can, for example, be ice cubes or beverages or water.

A particularly appealing visual impression results if, in the lowered position of the dispensing unit, the dispensing unit and/or the actuation element terminate flush with the regions of the unit surrounding them. These regions can, for example, be the outside or inside of the door and/or of the carcass of the unit.

It must generally be noted that the dispensing unit and/or the actuation element can be arranged inwardly (i.e. in the cooled inner space) or outwardly (i.e. at the door or at the carcass) at the unit.

The dispensing unit can—as stated—be a water dispenser and/or an ice dispenser, for example.

It is conceivable that the dispensing of the product takes place automatically when the dispensing unit is in its moved out position so that no further action by the user is necessary.

However, the case is also covered by the invention that the dispensing of the product is controlled or regulated by a separate mechanism such as by a switch or sensor, etc. which the user has to actuate when he desires the dispensing of the product.

The actuation element is preferably located below the dispensing unit. This brings about the advantage that the actuation element can be pressed in, by a glass for example, that can then be filled with the product (water, ice, etc.) from above after the moving out of the dispensing unit.

Provision is made in an embodiment that the dispensing unit and the actuation element are configured such that the dispensing unit independently moves back into the lowered position after the end of the actuation of the actuation element. This can take place mechanically, e.g. by a spring or also by means of a drive, e.g. by an electric motor.

The case is generally covered by the invention that the dispensing unit is actuated by a drive unit such as by an electric motor. It is, however, also conceivable that the dispensing unit is moved by the actuation element, i.e. that the actuation element and the dispensing unit are mechanically coupled such that the actuation of the actuation element leads to a moving out of the dispensing unit and/or that the return of the actuation element leads to a moving of the dispensing unit into the lowered position.

Provision is generally preferably made that the dispensing unit moves into its lowered position if the actuation element is not actuated.

The actuation element can be configured such that its actuation takes place by a movement or by a touching of the actuation element. The actuation element can, for example, be a switch, a sensor, or also a plate, etc.

The actuation element can form a component of the dispensing unit or can also be designed as a separate element, i.e. an element not associated with the dispensing unit.

The actuation element and the dispensing unit can be configured such that they move synchronously at least sectionally. It is thus, for example, conceivable that the pressing in of the actuation element takes place simultaneously with the moving out of the dispensing unit into the moved out position and/or conversely the return of the actuation element takes place simultaneously with the moving of the dispensing unit into the lowered position.

However, the case is also covered by the invention that such a synchronous movement does not take place, but that the movement of the actuation element and of the dispensing unit rather takes place offset in time or separately.

Provision is made in a particularly preferred embodiment of the invention that the actuation element and the dispensing unit are configured such that the amount and/or the amount/time unit, i.e. the dispensing rate of the product dispensed by the dispensing unit depends on the degree of actuation of the actuation element. This means that the stronger the actuation element is actuated, the more of the product to be dispensed is dispensed. For example, the amount of water (absolute or per time unit) and/or the water pressure can be regulated by the degree of the actuation such as the pressed in depth of the actuation element.

The actuation element is configured as a mechanically movable element or as a sensor.

The movement of the actuation element can, for example, be a press in movement, a pushing movement, or a rotary movement. A press in movement, e.g. by means of a glass or of a beaker, that leads to a moving out movement of the dispensing unit is preferred.

The actuation of the actuation element can generally take place by a hand or by a finger.

It is further conceivable that the actuation of the actuation element has the consequence of a switching on of a lighting and/or of a temperature display and/or of a permanent flowmeter and/or an actuation meter to display the number of button presses or actuations or another function of the unit.

Provision is made in a further embodiment of the invention that the actuation and/or the movement of the dispensing unit takes/take place manually or automatically or by means of at least one drive.

The dispensing unit can be configured such that its movement from the lowered position into the moved out position is a travel movement, a pivot movement, or a rotary movement. A superposition of these movements is also conceivable and covered by the invention.

Further details and advantages of the invention will be explained in more detail with reference to an embodiment shown in the drawing.

BRIEF DESCRIPTION OF THE DRAWINGS

There are shown.

DETAILED DESCRIPTION

Figure 1:
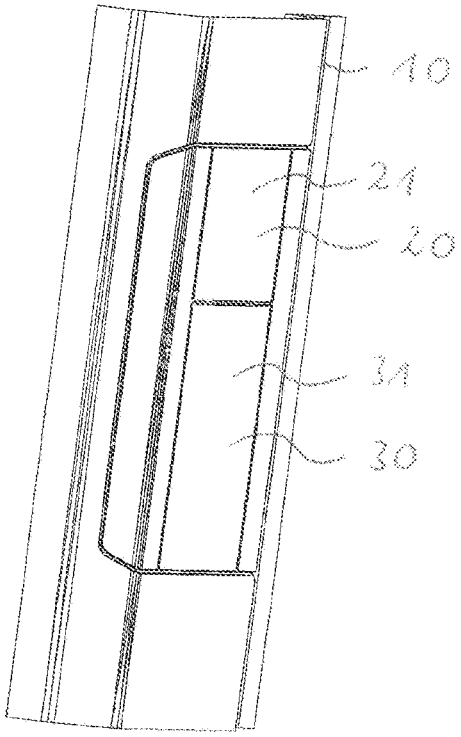
FIG. 1: a first perspective view of the dispensing unit and of the actuation element in the lowered position.

FIG. 1 shows by reference numeral 10 a component of a refrigerator unit and/or freezer unit such as a part of the inside of the door or a part of the carcass of the unit.

The dispensing unit is marked by the reference numeral 20 and the actuation element is marked by the reference numeral 30.

The dispensing unit 20 has a plate 21 that is arranged flush with the sections of the unit adjacent to the plate 21 in the lowered state of the dispensing unit 20 in accordance with FIG. 1 so that a visually appealing impression of an integration of the dispensing unit 20 in the unit results.

The same applies accordingly to the actuation element 30 that likewise has a plate 31 that is likewise arranged flush with the sections of the unit adjacent to the plate 31.

The plates 21 and 31 are directly above one another and are adjacent to one another when the dispensing unit is in its lowered position in accordance with FIG. 1.

In the lowered state in accordance with FIG. 1, the dispensing unit 20 is optimally protected from damage and contamination since it is closed to the outside.

Figure 2:
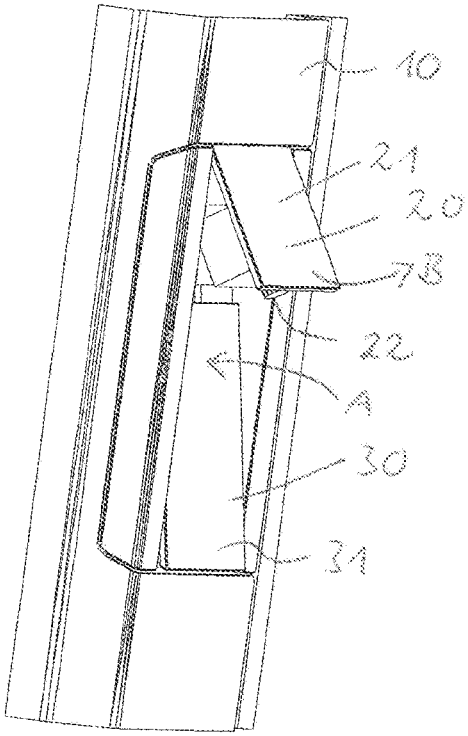
FIG. 2: a second perspective view of the dispensing unit in the moved out position and of the actuation element in the pressed in position.

The dispensing unit pivots outward in the direction of the arrow B, as is shown in FIG. 2 that shows the dispensing unit in its outwardly pivoted position, by the pressing in of the actuation element in the form of the plate 31 in the direction of the arrow A.

The dispensing of a product such as water or ice, etc. from the dispensing device 22 is made possible in this position. The dispensing takes place automatically as soon as the dispensing unit has reached a specific outwardly pivoted position. The dispensing can also take place in the inwardly pivoted state.

It is furthermore conceivable that the user has to activate a further actuation means when the dispensing of the product should start.

A lighting that illuminates the region of the dispensing device 22 can be simultaneously activated.

After the release of the actuation plate 31, i.e. on the stopping of the pressing in, the dispensing automatically stops and the dispensing unit 20 and the actuation unit 30 synchronously pivot or travel back into the position shown in FIG. 1.

The dispensing or the water pressure or the amount of ice can be regulated via the pressed in depth of the actuation element 31.

It is also generally conceivable to regulate the travel path or the outward pivot angle of the dispensing unit via the pressed in depth or via the degree of actuation. It is thus possible, for example, to achieve a pivoting of the dispensing unit that is the greater, the stronger or further the actuation element is actuated.

It is achieved by the present invention that the dispensing unit is only moved out when it is needed. It is otherwise in the well-protected position in accordance with FIG. 1 in which it is not accessible from the outside, but is rather arranged in a protected manner in a recess of the unit.

The invention claimed is:

1. A refrigerating unit that is a refrigerator, a freezer, or a refrigerator-freezer combination, the refrigerating unit comprising a dispenser for ice or water, and an actuator configured to move the dispenser from a retracted position to an active position upon actuation wherein the actuator and the dispenser are both arranged at an accessible surface of the refrigerating unit;

the actuator is positioned below the dispenser;

the dispenser comprises a nozzle and a cover surface;

the actuator comprises an actuation surface;

and wherein the cover surface is flush with the accessible surface when the dispenser is in a retracted position and the actuation surface is flush with the accessible surface when not actuated;

and the refrigerating unit is configured such that, upon actuation of the actuator, the actuation surface moves out of a plane formed by the accessible surface towards an inside of the refrigerating unit, while both the nozzle and the cover surface move out of the plane in a direction away from the refrigerating unit to assume the active position.

2. The refrigerating unit in accordance with claim 1, characterized in that the dispenser and the actuator are configured such that the dispenser automatically returns to the retracted position after the actuation of the actuator has stopped.

3. The refrigerating unit in accordance with claim 1, characterized in that movement of the dispenser is effected by a separate drive unit responding to the actuation of the actuator.

4. The refrigerating unit in accordance with claim 1, characterized in that the actuator and the dispenser are configured to move synchronously.

5. The refrigerating unit in accordance with claim 1, characterized in that the actuator and the dispenser are configured such that a dispensing rate of the ice or water is proportional to a degree of the actuation of the actuator.

6. The refrigerating unit in accordance with claim 1, characterized in that the actuator is configured such that upon actuation, the actuation surface moves out of the plane formed by the accessible surface towards the inside of the refrigerating unit by swivelling about an essentially horizontal axis.

7. The refrigerating unit in accordance with claim 1, characterized in that the refrigerating unit is further configured such that a light, a temperature display, a display showing a measured value of a flowmeter, a display showing a number of actuator actuations, or any combinations thereof, are activated upon the actuation of the actuator.

8. The refrigerating unit in accordance with claim 3, characterized in that the separate drive unit is an electric motor.

9. The refrigerating unit in accordance with claim 1, characterized in that the dispenser is configured such that, when assuming the active position, both the nozzle and the cover surface move out of the plane in a direction away from the refrigerating unit by swiveling about an essentially horizontal axis.

10. The refrigerating unit in accordance with claim 1, characterized in that movement of the dispenser is effected directly by the actuator.

* * * * *